US009663959B1

(12) United States Patent
Keller

(10) Patent No.: US 9,663,959 B1
(45) Date of Patent: May 30, 2017

(54) SCAFFOLDING APPARATUS AND METHOD OF USE

(71) Applicant: Martin Eibert Keller, Kill Devil Hills, NC (US)

(72) Inventor: Martin Eibert Keller, Kill Devil Hills, NC (US)

( * ) Notice: Subject to any disclaimer, the term of this patent is extended or adjusted under 35 U.S.C. 154(b) by 0 days.

(21) Appl. No.: 15/214,815

(22) Filed: Jul. 20, 2016

(51) Int. Cl.
*E04G 5/04* (2006.01)
*E04G 3/24* (2006.01)
*E04B 5/12* (2006.01)

(52) U.S. Cl.
CPC ..... *E04G 5/04* (2013.01); *E04B 5/12* (2013.01); *E04G 3/24* (2013.01)

(58) Field of Classification Search
CPC ..... E04G 5/04; E04G 3/24; E04B 5/12
USPC ..... 52/698, 711, 651.1
See application file for complete search history.

(56) References Cited

U.S. PATENT DOCUMENTS 1,141,554 A 6/1915 Klumpp
1,698,508 A * 1/1929 Pimm ..... E04G 5/04 182/229
2,103,010 A * 12/1937 Kohnke ..... E04G 5/04 52/27
3,156,018 A * 11/1964 Slayter ..... E04B 1/348 52/223.7
3,310,132 A * 3/1967 Rolland ..... E04F 11/028 182/189
3,679,026 A * 7/1972 Hansen ..... E04G 3/18 182/128
3,818,083 A * 6/1974 Butts ..... E04B 5/29 264/31
3,820,293 A * 6/1974 Ohe et al. ..... E04B 1/2604 52/127.12
3,841,597 A * 10/1974 Butts ..... E04B 5/32 249/210
3,945,168 A * 3/1976 Butts ..... E04B 5/29 248/351
3,979,868 A * 9/1976 Butts ..... E04B 5/29 52/334
4,096,922 A * 6/1978 Fisher ..... E04G 3/34 182/142
4,425,982 A * 1/1984 Kibbie ..... A62B 5/00 182/3
5,653,077 A * 8/1997 Carnicello ..... E04B 5/40 52/338
6,625,943 B1 * 9/2003 Renner ..... E04B 1/165 52/250

(Continued)

FOREIGN PATENT DOCUMENTS

JP 05113031 A * 5/1993
JP 10169078 A * 6/1998

*Primary Examiner* — Brent W Herring
(74) *Attorney, Agent, or Firm* — Ted Masters

(57) ABSTRACT

Scaffolding apparatus cooperates with a flooring structure of a building which has rim joists and floor joists. The scaffolding apparatus includes a sleeve which is inserted through an aperture in a rim joist and connected to the rim joist. A platform support arm for supporting a platform is inserted into the sleeve and removably locked in place. The sleeve is prevented from moving upward under a platform load by at least one of the floor joists. The scaffolding apparatus can either be installed perpendicular to or parallel with the floor joists.

16 Claims, 12 Drawing Sheets

(56) References Cited

U.S. PATENT DOCUMENTS

| | | | | |
|---|---|---|---|---|
| 7,228,938 | B1 * | 6/2007 | Mitchell | E04G 3/22 182/113 |
| 8,413,386 | B2 * | 4/2013 | Fazekas | E04B 1/003 52/302.6 |
| 8,499,889 | B2 * | 8/2013 | DuBose | B23Q 3/062 182/223 |
| 8,622,172 | B2 * | 1/2014 | Murphy | E04G 3/18 182/53 |
| 8,820,033 | B2 * | 9/2014 | Yang | E04C 3/17 29/428 |
| 9,145,669 | B1 * | 9/2015 | Broughton | E04B 1/40 |
| 9,228,364 | B1 * | 1/2016 | Dubose | B23Q 3/062 |
| 2004/0050009 | A1 * | 3/2004 | Fuhr | E04B 1/0046 52/650.3 |
| 2005/0102914 | A1 * | 5/2005 | Fazekas | E04B 1/003 52/58 |
| 2007/0193195 | A1 * | 8/2007 | Smith | E04B 5/12 52/702 |
| 2013/0239512 | A1 * | 9/2013 | Yang | E04C 3/17 52/741.3 |
| 2013/0248286 | A1 * | 9/2013 | Murphy | E04G 3/18 182/53 |
| 2015/0315777 | A1 * | 11/2015 | Broughton | E04B 1/40 52/289 |

* cited by examiner 22
28
29

22
26
34
24
28

22
28
29

22
26
34
V
V 22
36
34

22
36

22
36
28

SCAFFOLDING APPARATUS AND METHOD OF USE

CROSS REFERENCE TO RELATED APPLICATION

None

TECHNICAL FIELD

The present invention pertains generally to buildings, and more particularly to scaffolding apparatus which can be used both during initial building construction and during subsequent building maintenance and other work.

BACKGROUND OF THE INVENTION

Normal framing of a multi-story building, such as a house or commercial building involves framing floors with joists which span the area to create a flooring structure. Floor boards are then placed over the joists. As each level of the building is added this flooring structure is repeated.

Moreover, during the construction process, there are several steps which require the use of scaffolding for the exterior of the building. For example, once all the studding of walls is completed, scaffolding is required to install the exterior sheathing. This involves the cutting and securing of plywood to the exterior side of the wall studs. Other steps to reach a finished building which occasion the need for scaffolding are house-wrap, siding/brick work, windows, gutters, eve covers, trim, painting, . . . etc. Many of the these steps cannot be performed while working on a ladder which is leaned against the building, particularly for buildings having more than two stories.

Therefore, the contractor must erect scaffolding for the various tradesmen to stand on while working with both hands free. Scaffolding comes in three basic types. The first and most common is "free-standing". This is a structure which must be assembled like an erector set, with a plurality of legs and walking surfaces, and is not physically attached to the house structure. It is very time consuming to erect and costly if rented. Another structure is called a "pump-jack" scaffold. This typically involves single columns that are temporarily attached to the exterior of the house for support, with the bottom of the column resting on the ground. After a few of these are set up, walking surfaces are laid on an arm that extends from the columns. A foot on these arms is then pumped make the support arms climb the column. Motorized manlifts, also known as "cherry pickers", are another type of scaffolding system. These also are very costly to own or rent, and may not fit in all areas around a building. In fact, if the building is being constructed where one of the exterior walls is on a steep hillside, "free-standing" and "cherry-picker" scaffolding will not work at all. It is also very dangerous to setup "pump-jacks" on a steep hill.

BRIEF SUMMARY OF THE INVENTION

The present invention is directed to scaffolding apparatus which is installed through the rim joist of a building (such as a house or commercial building), and becomes a permanent feature of the building. The scaffolding apparatus can be used both during initial building construction such as for sheathing, windows, siding or brick, finish trim, painting, and the like, and also at a later time for building maintenance or future work. As a result the time and expense of erecting conventional scaffolding is avoided.

The scaffolding apparatus consists of two main elements, a sleeve and a platform support arm. The sleeve is installed permanently in a hole drilled through the rim joist. The sleeve forms a socket for the removable connection of the platform support arm. Platforms are then placed across two or more adjacent platform support arms, and provide walking surfaces for construction and maintenance personnel.

The scaffolding apparatus allows the builder/contractors to erect scaffolding, extremely fast and at very low cost; and when the building is complete, the scaffolding apparatus provides a useful maintenance feature for the building owner. When each level of a multi-story building reaches the stage where all the floor joist are in place, but the sub-floor sheathing has not been installed, a plurality of sleeves are installed every 4-6 feet in the rim joists around the outside of the building. Additionally, the platform support arm is removably connected to the sleeve by a unique lock which employs a pair of L-shaped slots at the end of the platform support arm which engage a locking rod in the sleeve.

Once the sleeves are fully installed the carpenters continue by laying the subflooring, building walls on top of the sub-floors, and eventually if required the network of joists and sleeves for the next level of the building. The builder/contractor then places a platform support arm into each of the permanently installed sleeves. Once the support arms are in place, standard scaffold walking surfaces (platforms such as planks or other planar members) are placed on top of the platform support arms. Workers can then install exterior sheathing, siding, windows and other exterior components of the building while having a solid scaffold surface to walk and work on. After all exterior work is completed, the platforms and the platform support arms are removed. A cap is placed in the opening of the sleeve. The cap is designed to match the siding of the building.

It is noted however, that the building now has a convenient built-in maintenance feature, which can substantially reduce the cost of future work and maintenance. In that event, the caps are removed, the platform support arms re-installed, and platforms are placed upon the platform support arms. Moreover, it is noted that any contractor only has to own a handful of the platform support arms and their own scaffold walkways. One could carry enough of the these in the corner of their truck bed vs. trailer loads of traditional free-standing scaffold elements.

The installation of the sleeves is such that they are prevented from moving upward when a load is placed upon the platform/platform support arms. The sleeves are upwardly restrained by interaction with one or more of the floor joists. In one case the sleeve passes through an aperture in the floor joist and is thereby prevented from moving upward, and in another instance a stop is connected between two adjacent floor joists to prevent upward movement of the sleeve.

In accordance with an embodiment, scaffolding apparatus cooperates with a flooring structure, the flooring structure including (1) a rim joist which has a rim joist aperture, and (2) a plurality of floor joists. The scaffolding apparatus includes a sleeve which is shaped and dimensioned to be received by the rim joist aperture. The sleeve has a proximal section which includes a connector for connecting the sleeve to the rim joist. The sleeve is positionable so that (1) the sleeve passes through the rim joist aperture and the connector is adjacent to the rim joist, and (2) the sleeve is restrained by at least one of the plurality of floor joists such that the sleeve is prevented from moving upward. A platform support arm is shaped and dimensioned to be received by the sleeve and outwardly project therefrom.

In accordance with another embodiment, the plurality of floor joists include a parallel floor joist which is disposed adjacent to and parallel with the rim joist, the parallel floor joist has a floor joist aperture. The sleeve is shaped and dimensioned to be received by the floor joist aperture, and the sleeve is positionable so that the sleeve passes through the floor joist aperture, and is prevented from moving upward.

In accordance with another embodiment, the plurality of floor joists include two adjacent floor joists which are disposed perpendicular to the rim joist. A stop is connectable between the two adjacent floor joists so that the stop is disposed above and adjacent to the sleeve, and prevents the sleeve from moving upward.

In accordance with another embodiment, the rim joist aperture has a bottom. When received by the rim joist aperture, the sleeve abuts the bottom of the rim joist aperture.

In accordance with another embodiment, a lock removably connects the platform support arm to the sleeve.

In accordance with another embodiment, the lock includes the platform support arm being a tube which has a distal end. The distal end has two contrapositioned L-shaped slots. The sleeve includes a locking rod which is disposed along a diameter of the sleeve. The L-shaped slots are shaped and dimensioned to twistedly engage the locking rod.

In accordance with another embodiment, the two L-shaped slots each including a tapered base section.

In accordance with another embodiment, the sleeve includes a plurality of pairs of spaced apart contrapositioned holes which are shaped and dimensioned to receive the locking rod.

In accordance with another embodiment, the scaffold apparatus cooperates with a vertical scaffold member. The platform support arm has a proximal end which includes a collar which is shaped and dimensioned to receive the vertical scaffold member.

Other embodiments, in addition to the embodiments enumerated above, will become apparent from the following detailed description, taken in conjunction with the accompanying drawings, which illustrate, by way of example, the principles of the scaffolding apparatus and method of use.

DETAILED DESCRIPTION OF THE INVENTION

Figure 1:
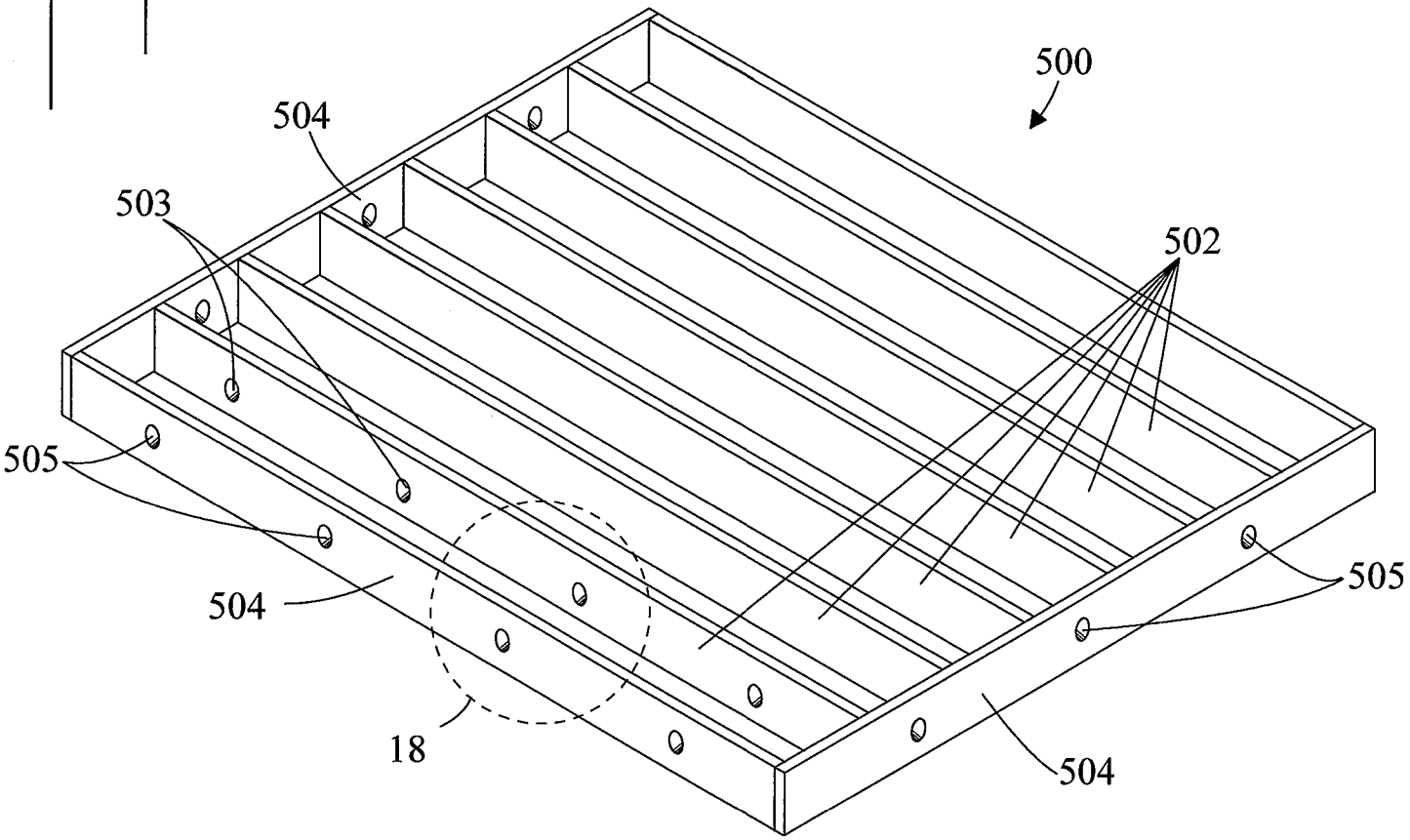
FIG. 1 is a reduced perspective view of a flooring structure of a building.
Figure 2:
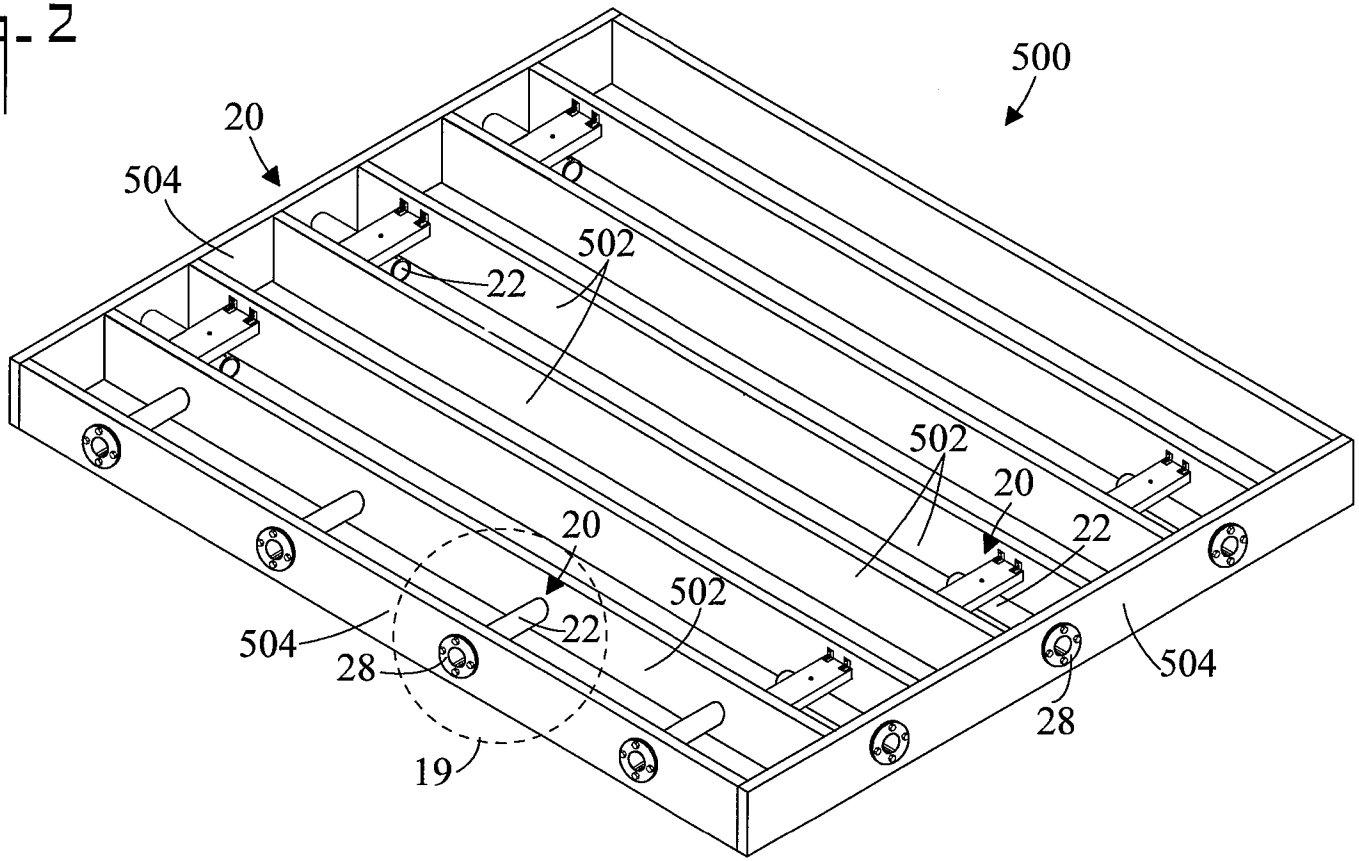
FIG. 2 is a reduced perspective view of the flooring structure with certain elements of a scaffolding apparatus installed.
Figure 3:
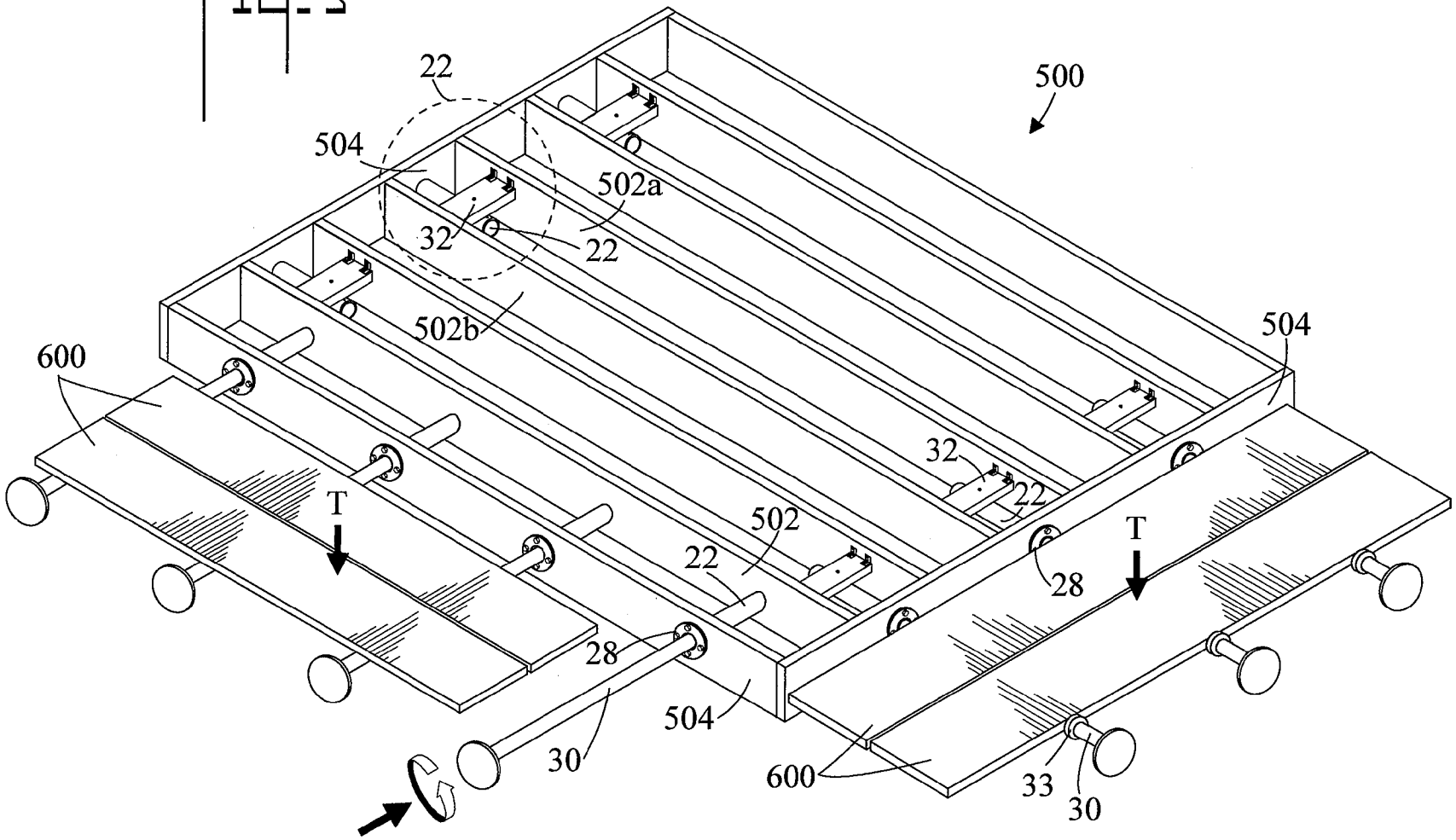
FIG. 3 is a reduced perspective view with additional elements of the scaffolding apparatus installed.

FIG. 1 is a reduced perspective view of a flooring structure of a building generally designated as 500. FIG. 2 is a reduced perspective view of flooring structure 500 with certain elements of a scaffolding apparatus 20 installed. And, FIG. 3 is a reduced perspective view with additional elements of the scaffolding apparatus 20 installed. Flooring structure 500 includes a plurality of floor joists 502 and rim joists 504. As used herein, floor joists 502 are an array of horizontal, parallel, spaced apart members which form flooring structure 500. Rim joists 504 are the members which are connected to floor joists 502 and comprise the outside perimeter of the flooring structure 500. Rim joists 504 can either be parallel with or perpendicular to floor joists 502. Rim joists 504 have rim joist apertures 505, and floor joists 502 have floor joist apertures 503. These apertures are made by drilling or other means and are for the specific purpose of installing the present scaffolding apparatus 20.

Also referring to the discussions below, in the present invention sleeves 22 are connected to rim joists 504 and at least one floor joists 502. As can be seen in FIG. 3, the connection of sleeves 22 can be accomplished in two ways. If the rim joist 504 is parallel to the floor joist 502, the connection is effected by passing sleeve 22 through apertures in both the rim joist 504 and the adjacent floor joist 502. Conversely if the rim joist 504 is perpendicular to the floor joists 502, the connection is effected by a stop 32 which is connected between two adjacent floor joists 502. In both cases the floor joist(s) serve to prevent sleeve 22 from moving upward when a platform load is applied.

Figures 18, 19, 20:
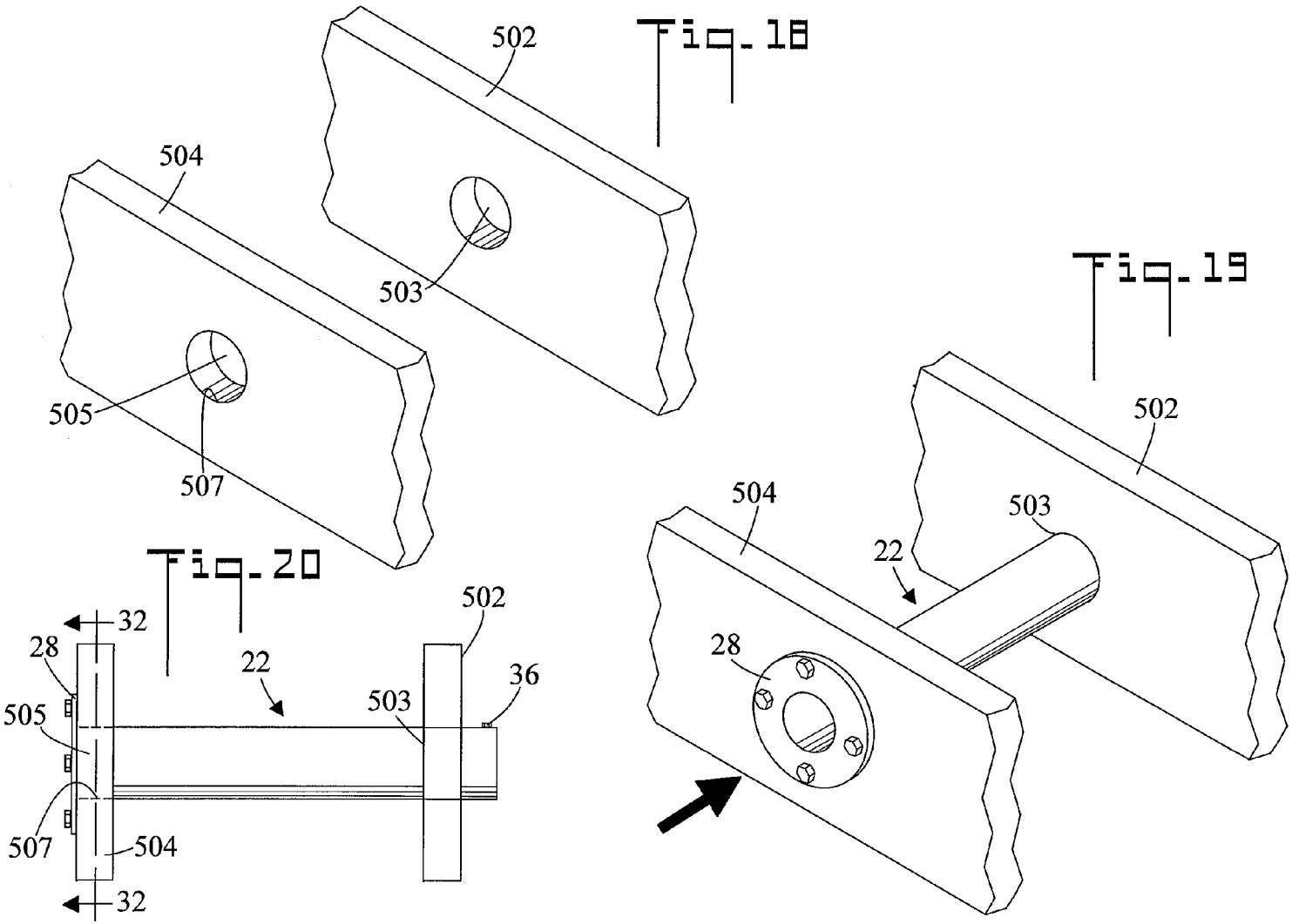
FIG. 18 is an enlarged fragmented perspective view of a rim joist and an adjacent floor joist.
FIG. 19 is an enlarged fragmented perspective view of the sleeve passing through the rim joist and the floor joist.
FIG. 20 is a an enlarged side elevation view of the sleeve passing through the rim joist and the floor joist.

When rim joist 504 is parallel to floor joists 502, scaffolding apparatus 20 cooperates with (1) a rim joist 504 which has a rim joist aperture 505, and (2) a parallel floor joist 502 which is disposed adjacent to and parallel with rim joist 504, the parallel floor joist 502 having a floor joist aperture 503 (refer to FIGS. 18-20). Scaffolding apparatus 20 includes a sleeve 22 which is shaped and dimensioned to be received by rim joist aperture 505 (refer to FIGS. 4-10). Sleeve 22 has a proximal section 24 and an opposite distal section 26. Proximal section 24 includes a connector 28 (a flange as shown) for connecting sleeve 22 to rim joist 504. Sleeve 22 is positionable so that it horizontally passes through rim joist aperture 505 and connector 28 is adjacent to rim joist 504 (refer to FIGS. 18-20). Sleeve 22 is also shaped and dimensioned to be received by floor joist aperture 503. Sleeve 22 is positionable so that it horizontally passes through floor joist aperture 503 (refer to FIGS. 18-20). A platform support arm 30 is shaped and dimensioned to be slidably and removably received by sleeve 22 and outwardly project therefrom (refer to FIGS. 11-14). A plurality of platform support arms 30 can then support a platform 600 upon which a workman can stand. In the shown embodiment the platform 600 includes a plurality of planks. It is noted that sleeve 22 passes through both rim joist 504 and floor joist 502. As such, sleeve 22 is held firmly in place and is prevented from moving upward when a torquing force T from the downward weight of the platform 600 and its occupants is applied.

Figure 21:
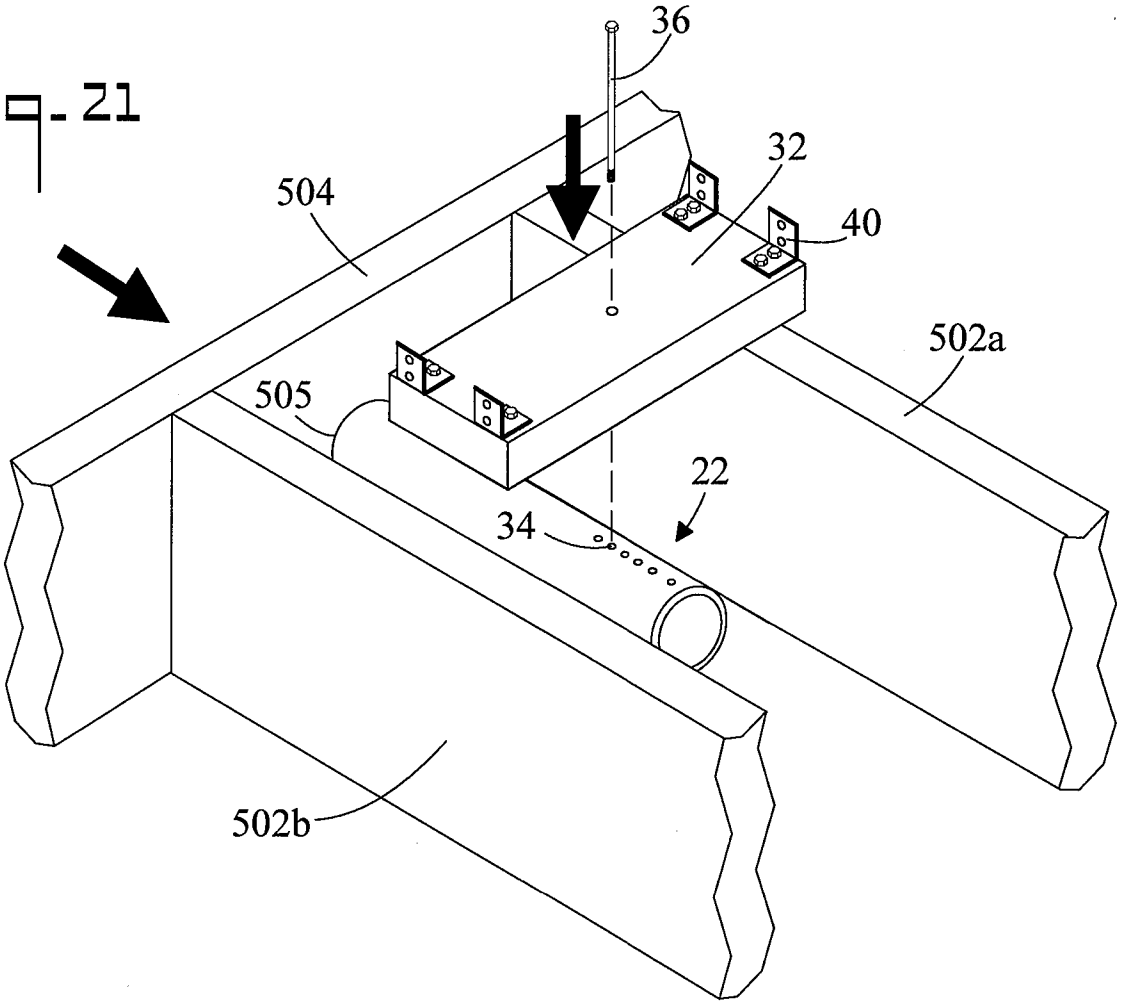
FIG. 21 is an enlarged fragmented perspective view of the sleeve cooperating with a rim joist and two adjacent perpendicular floor joists, with a stop being connected between the floor joists.
Figure 23:
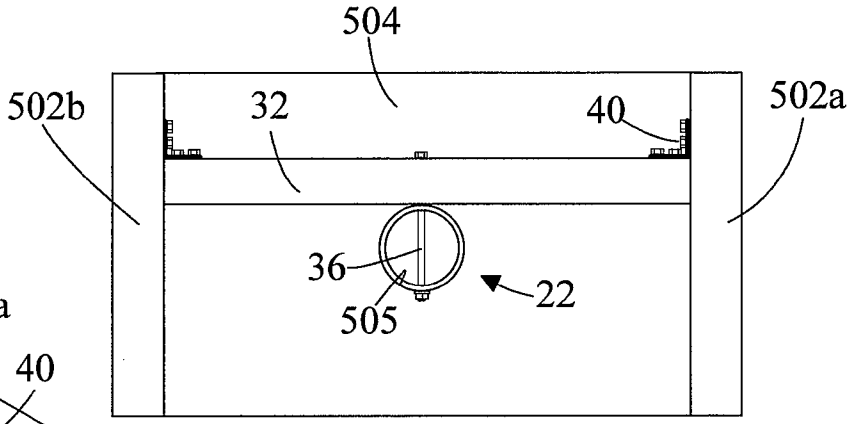
FIG. 23 is and end elevation view as in FIG. 22.
Figure 22:
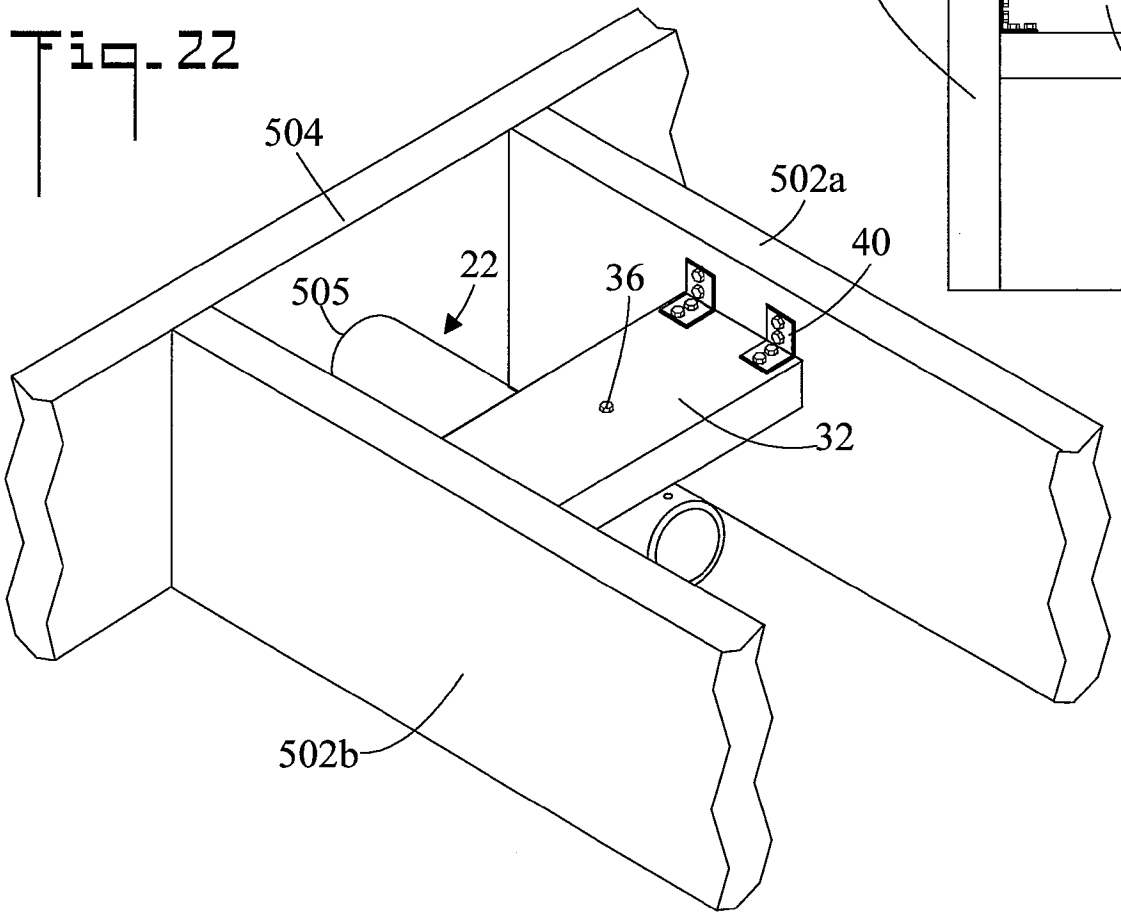
FIG. 22 is an enlarged fragmented perspective view with the stop connected above and adjacent to the sleeve.

Conversely, when rim joist 504 is perpendicular to floor joists 502, scaffolding apparatus 20 cooperates with (1) a rim joist 504 which has a rim joist aperture 505, and (2) two adjacent floor joists 502*a* and 502*b* which are disposed perpendicular to rim joist 504 (refer to FIGS. 21-23). Scaffolding apparatus 20 includes a sleeve 22 which is shaped and dimensioned to be received by rim joist aperture 505. Sleeve 22 has a proximal section 24 which includes a connector 28 for connecting sleeve 22 to rim joist 504. Sleeve 22 is positionable so that sleeve 22 passes through rim joist aperture 505 and connector 28 is adjacent to rim joist 504. Scaffolding apparatus 20 further includes a stop 32 which is connectable between the two adjacent floor joists 502*a* and 502*b* so that stop 32 is disposed above and adjacent to sleeve 22. In the shown embodiment stop 32 includes a wooden brace which is installed between floor joists 502*a* and 502*b* by angle brackets 40. It may be appreciated however that other forms of stops 32 such as wooden braces with apertures, metal pipes, bars, and the like could also be employed to prevent upward movement of sleeve 22.

A platform support arm 30 is shaped and dimensioned to be received by sleeve 22 and outwardly project in cantilever fashion therefrom. In the shown embodiment, platform support arm 30 slides into sleeve 22. A plurality of platform support arms 30 can then support platform 600 upon which a workman can stand. In the shown embodiment the platform 600 includes a plurality of planks. It is noted that sleeve 22 passes through rim joist 504 and is disposed next to stop 32.

It is noted that in both the parallel joist embodiment of FIGS. 18-20 and the perpendicular joist embodiment of FIGS. 21-23, sleeve 22 is held fixedly in place by rim joist 504 and floor joist(s) 502. That is, sleeve 22, and particularly distal end 26 of sleeve 22, is prevented from moving upward (e.g. rotating upward about connected proximal end 24) when a load (such as a torquing force T from the weight of the platform 600) is applied to the platform support arm 30 (refer also to FIG. 3).

In general terms, scaffolding apparatus 20 cooperates with a flooring structure 500, the flooring structure 500 including (1) a rim joist 504 which has a rim joist aperture 505, and (2) a plurality of floor joists 502. Scaffolding apparatus 20 includes a sleeve 22 which is shaped and dimensioned to be received by rim joist aperture 505. Sleeve has a proximal section 24 which includes a connector 28 for connecting sleeve 22 to rim joist 504. Sleeve 22 is positionable so that (1) sleeve 22 passes through rim joist aperture 505 and connector 28 is adjacent to rim joist 504, and (2) sleeve 22 is restrained by at least one of the plurality of floor joists 502 such that sleeve 22 is prevented from moving upward. As used herein the term "restrained" embraces both the parallel floor joist embodiment in which sleeve 22 passes through floor joist aperture 503 and is thereby prevented from moving upward, and the perpendicular floor joist embodiment in which stop 32 is connected between two adjacent floor joists 502 and prevents upward movement of sleeve 22. In an embodiment, slidable lockable collars 33 on the platform support arms 30 keep the platform 600 from moving on the platform support arms 30 (also refer to FIG. 16).

FIGS. 4-7 are top plan, side elevation, bottom plan, and perspective views respectively of sleeve 22. In the shown embodiment, sleeve 22 is a cylindrical tube (also refer to FIG. 31), however it may be appreciated that sleeve 22 (and corresponding platform support arm 30) could have other shapes such as rectangular. Sleeve 22 has a proximal section 24 and an opposite distal section 26. Proximal section 24 includes connector 28, which in the shown embodiment is a flange which includes four screw mounting holes 29. Sleeve 22 is fabricated from a material, such as a metal, which will provide sufficient structural strength to support a scaffolding platform 600 and its contents (refer to FIG. 3). Distal section 26 includes a plurality of pairs of spaced apart contrapositioned holes 34 which are shaped and dimensioned to receive a locking rod 36 (refer to discussion below). The plurality of holes 34 provide the installer of scaffolding apparatus 20 with installation flexibility. For example, if a ventilation duct or other obstacle interferes with the installation of sleeve 22, the sleeve 22 can be shortened by cutting off a portion of distal section 26, and two holes 34 would still be available for locking rod 36. It is also noted that in the installed configuration of sleeve 22, each of the pairs of spaced apart contrapositioned holes 34 are oriented along a vertical axis V. This facilitates installation of locking rod 36 in the perpendicular joist embodiment wherein it is installed through stop 32 (refer to FIG. 21). To facilitate this alignment, two of the screw mounting holes 29 in connector 28 are also oriented along a vertical axis V.

Figures 4, 5, 6, 7, 8, 9, 10:
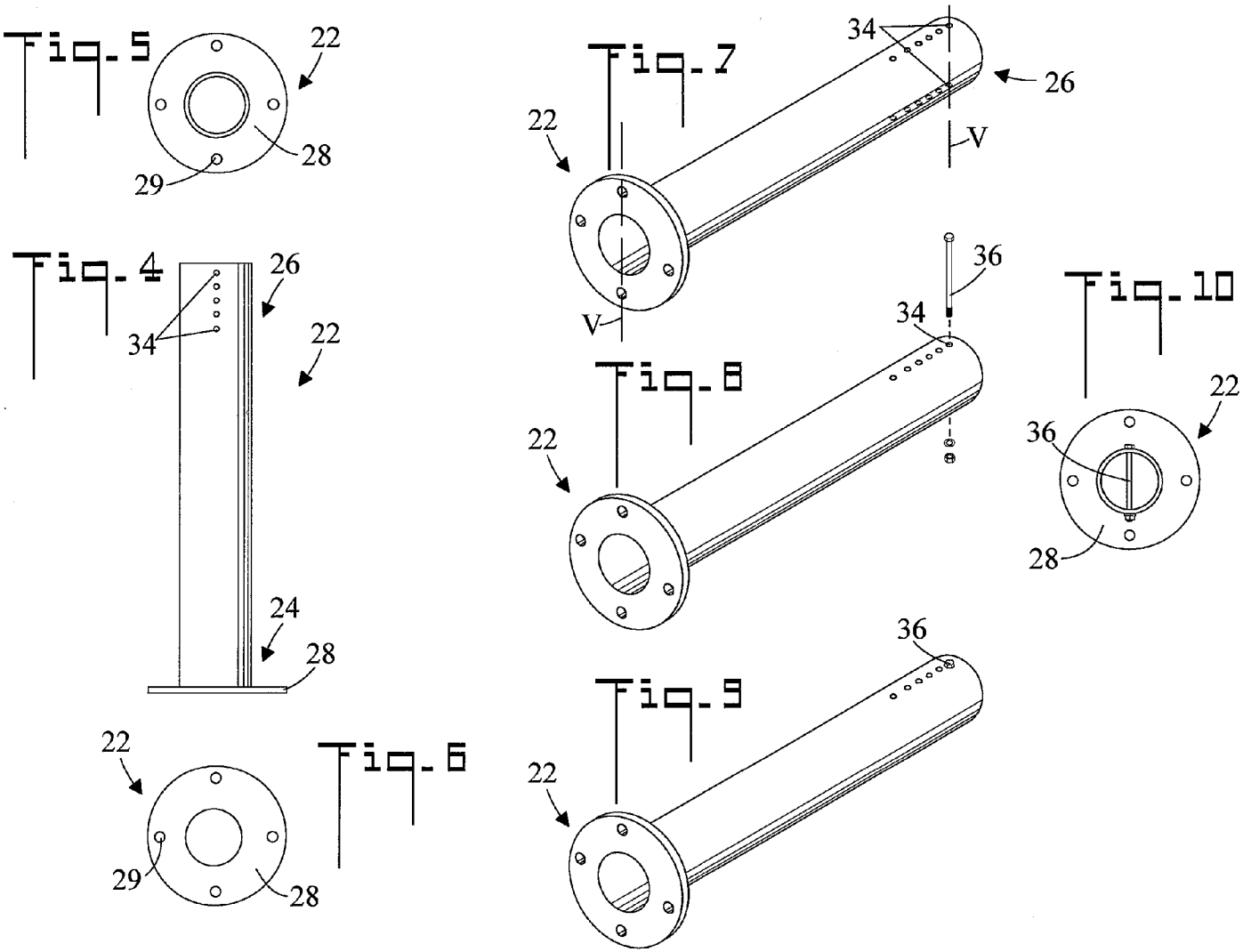
FIG. 4 is a top plan view of a sleeve.
FIG. 5 is a side elevation view of the sleeve.
FIG. 6 is a bottom plan view of the sleeve.
FIG. 7 is a perspective view of the sleeve.
FIG. 8 is an exploded perspective view of the sleeve with a locking rod being connected to the sleeve.
FIG. 9 is a perspective view of the sleeve with the locking rod connected.
FIG. 10 is an end elevation view of the sleeve and locking rod.

FIG. 8-9 show the sequence of connecting locking rod 36 to the distal section 26 of sleeve 22. Locking rod 36 (such as the shown bolt) is placed through one of the pairs of contrapositioned holes 34 and tightened in place. Locking rod 36 is disposed along a diameter of sleeve 22. Refer also to FIGS. 21-23 for a different installation of locking rod 36.

FIGS. 11-14 are side elevation, end elevation, opposite end elevation, and perspective views respectively of platform support arm 30. In the shown embodiment, platform support arm 30 is also a cylindrical tube (also refer to FIG. 31) having a distal end 31. However it may be appreciated that platform support arm 30 (and corresponding sleeve 22) could have other shapes such as rectangular. Platform support arm 30 is fabricated from a material, such as a metal, which will provide sufficient structural strength to support a scaffolding platform 600 and its contents (refer to FIG. 3).

Referring to FIGS. 15, 17, and 24 through 26, scaffolding apparatus 20 includes a lock for removably connecting platform support arm 30 to sleeve. In the shown embodiment, the lock includes the distal end 31 of platform support arm 30 having two contrapositioned L-shaped slots 38. L-shaped slots 38 are shaped and dimensioned to twistedly engage locking rod 36. The two L-shaped slots each include a tapered base section 39 which downwardly tapers toward the end of the slot as is shown by the arrows. Platform support arm 30 is inserted at the proximal section 24 of sleeve 22 and moved as far as possible through sleeve 22 until L-shaped slots 38 receives locking rod 36 (refer also to FIG. 3). Platform support arm 30 is then twisted to force locking rod 36 into tapered base sections 39. Because of the downward taper of base sections 39, during twisting locking rod 36 abuts the walls of base section 39 and is held in place. This feature removably locks platform support arm 30 and sleeve 22 together. For removal, platform support arm 30 is twisted in the opposite direction and withdrawn from sleeve 22.

Figures 11, 12, 13, 14, 15:
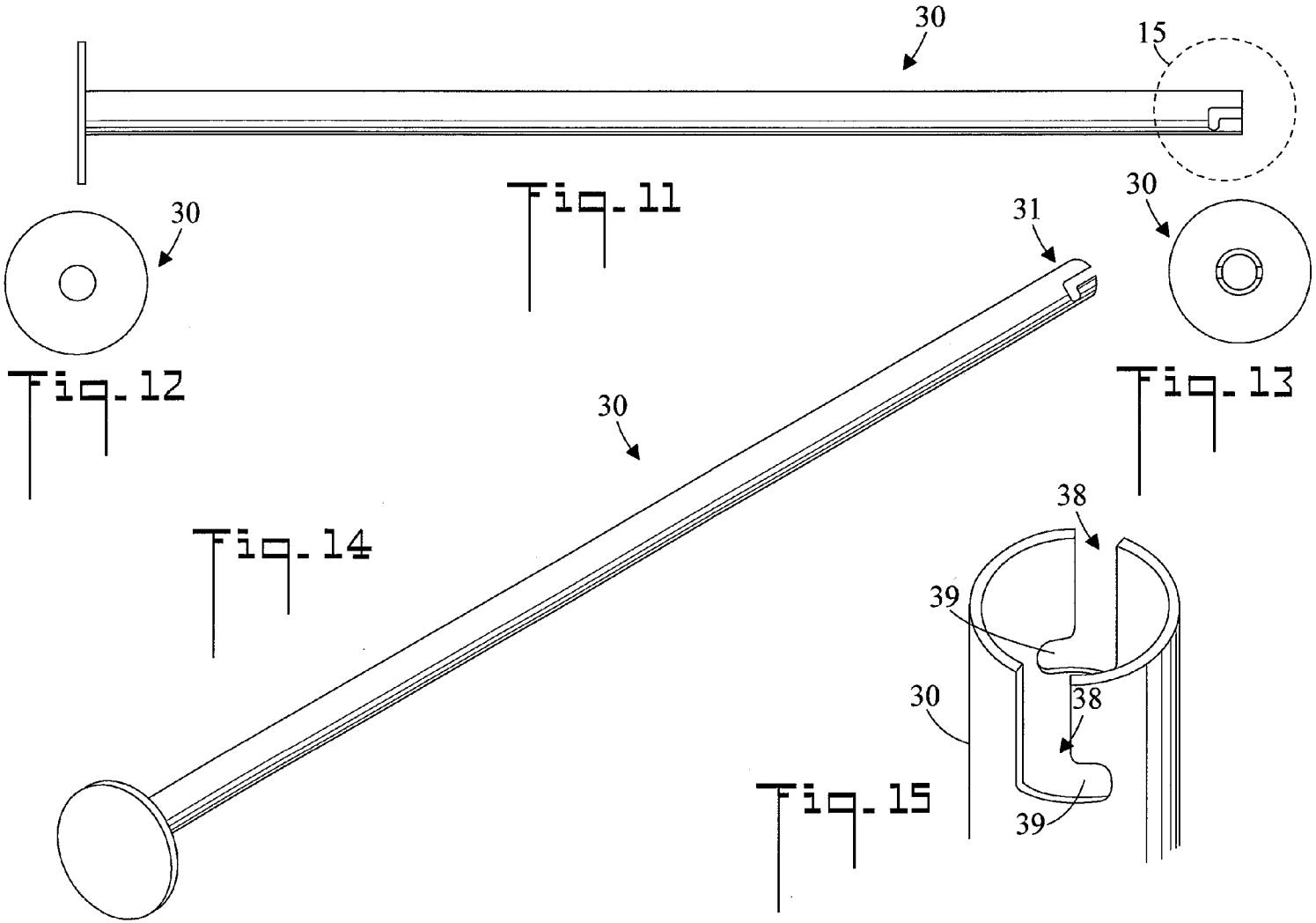
FIG. 11 is a side elevation view of a platform support arm.
FIG. 12 is an end elevation view of the platform support arm.
FIG. 13 is an opposite end elevation view of the platform support arm.
FIG. 14 is a perspective view of the platform support arm.
FIG. 15 is an enlarged fragmented perspective view of area 15 of FIG. 11.
Figure 16:
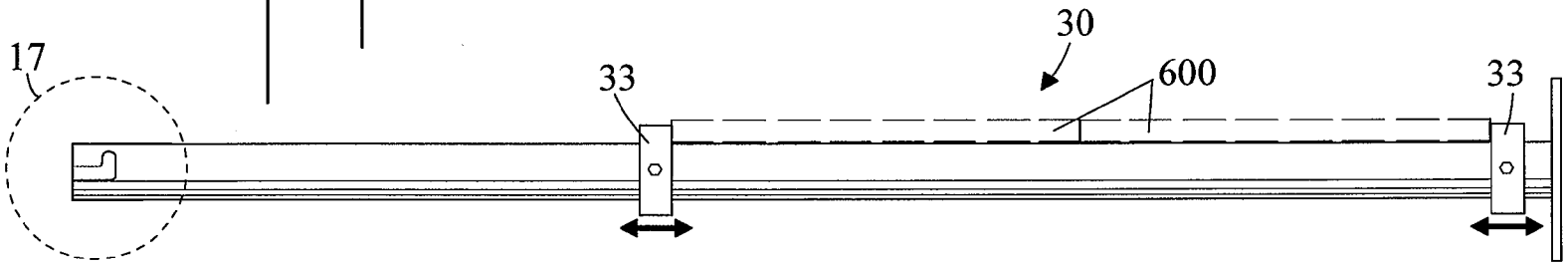
FIG. 16 is an opposite side elevation view of the platform support arm.
Figure 17:
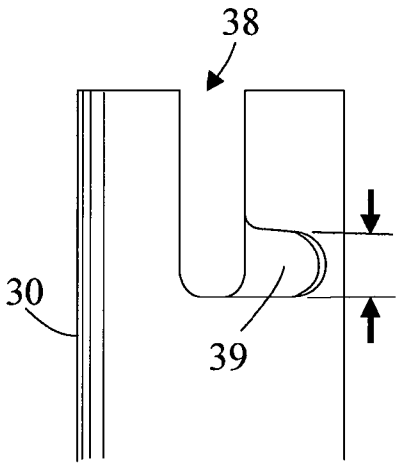
FIG. 17 is an enlarged fragmented perspective view of area 17 of FIG. 16.

FIG. 15 is an enlarged fragmented perspective view of area 15 of FIG. 11, FIG. 16 is an opposite side elevation view of platform support arm 30, and FIG. 17 is an enlarged fragmented perspective view of area 17 of FIG. 16. Shown are platform support arm 30, distal end 31, L-shaped slots 38, and tapered base sections 39. It is noted that the tapered base sections 39 are oriented (point) in the same direction around the perimeter of platform support arm 30. Also in FIG. 16, it is noted that longitudinally adjustable collars 33 have been added to platform support arm 30 to lock platform members 600 in place (refer also to FIG. 3).

FIG. 18 is an enlarged fragmented perspective view of a rim joist 504 and an adjacent floor joist 502. FIG. 19 is an enlarged fragmented perspective view of the sleeve 22 passing through the rim joist 504 and the floor joist 502. FIG. 20 is an enlarged side elevation view of the sleeve 22 passing through the rim joist 504 and the floor joist 502. As discussed above, this is the parallel floor joist 502 embodiment of scaffolding apparatus 20. Shown are, floor joist 502, floor joist aperture 503, rim joist 504, rim joist aperture 505, sleeve 22, proximal section 24, distal section 26, and connector 28. In FIG. 20 it is noted that rim joist aperture 505 has a bottom 507 (the lowest point of the aperture). When received by the rim joist aperture 505, sleeve 22 abuts the bottom 507 of rim joist aperture 505 (also refer to FIG. 32). It is very important that the sleeve 22 passing through the rim joist 504 rest on the bottom of the hole cut. This assures that as weight is applied to the sleeve 22, the load is in direct contact with the rim joist 504. If a hole is drilled that is say ¼ inch too large in diameter, it is important that the sleeve not be centered and held in this position by the screws in the outside flange (connector 28). This would result in all of the weight (i.e. from platform 600 and its contents) being supported by screws, rather than the sleeve 22 resting on the bottom of the hole. In FIG. 20 it is also noted that when installed sleeve 22 is horizontal.

As a standard or code in the framing industry, there are rules about cutting holes through joists. As a general rule joists that span an open area may not have a hole any larger than ⅓ the distance across the joist. For example, if a joist measures 9 inches across, a hole up to 3 inches in diameter, but no larger, can be drilled through the center of the joist. However, when drilling holes through rim joists the rule is different. Rim joists rest there entire length on a foundation wall or load bearing wall. As a result, much large holes can be drilled. This is often done when installing the vent pipe for a bathroom exhaust fan or dryer duct to the outside world. As a result, the present scaffolding apparatus 20 will have no difficulty meeting code for the hole size.

FIG. 21 is an enlarged fragmented perspective view of sleeve 22 cooperating with a rim joist 504 and two adjacent perpendicular floor joists 502*a* and 502*b*, with a stop 32 being connected between the floor joists 502. Floor joists 502*a* and 502*b* are disposed next to each other in the parallel array of floor joists 502. FIG. 22 is an enlarged fragmented perspective view with the stop 32 connected above and adjacent to the sleeve 22, and FIG. 23 is and end elevation view as in FIG. 22. As discussed above, this is the perpendicular floor joist 502 embodiment of scaffolding apparatus 20. Sleeve 22 passes through rim joist aperture 505 and is disposed between floor joists 502*a* and 502*b*. Stop 32 is positioned above sleeve 22 and connected to floor joists 502*a* and 502*b* with heavy duty angle brackets 40. Locking rod 36 is inserted through a hole in stop 32 and holes 34 in sleeve 22. When connected to the floor joists, stop 32 prevents sleeve from moving upward when a downward torquing force T is applied to platform 600 (refer to FIG. 3).

Figures 24, 25, 26, 27:
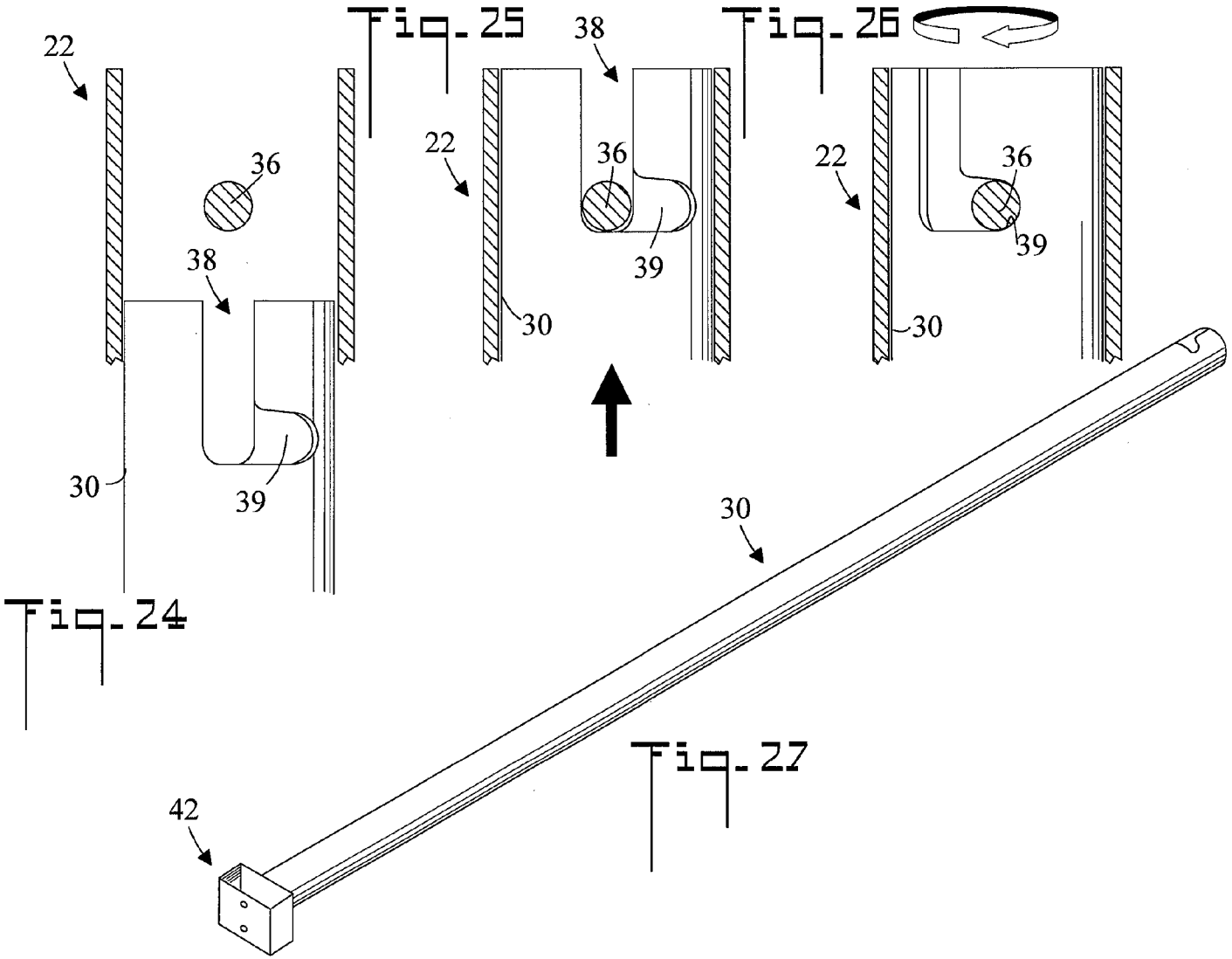
FIG. 24 is an enlarged fragmented side elevation view of a lock for removably connecting the platform support arm to the sleeve.
FIG. 25 is an enlarged fragmented side elevation view of the platform support arm fully inserted into the sleeve.
FIG. 26 is an enlarged fragmented side elevation view of the platform support arm twisted to effect locking with the sleeve.
FIG. 27 is a perspective view of the platform support arm having a collar for receiving a vertical scaffold member.

FIG. 24 is an enlarged fragmented side elevation view of a lock for removably connecting platform support arm 30 to sleeve 22 (refer to FIGS. 10 and 23). FIG. 25 is an enlarged fragmented side elevation view of platform support arm 30 fully inserted into sleeve 22. FIG. 26 is an enlarged fragmented side elevation view of platform support arm 30 twisted to effect locking with sleeve 22. FIGS. 24-26 show the sequence of removably connecting platform support arm 30 to sleeve 22. Platform support arm 30 is inserted into sleeve 22 so that L-shaped slots 38 receive locking rod 36. The insertion continues until locking rod 36 abuts tapered base sections 39. Platform support arm 30 is then rotated so that tapered base sections 39 receive and hold locking rod 36. These steps are performed in the reverse sequence to remove platform support arm 30 from sleeve 22.

Figures 28, 29, 30, 31:
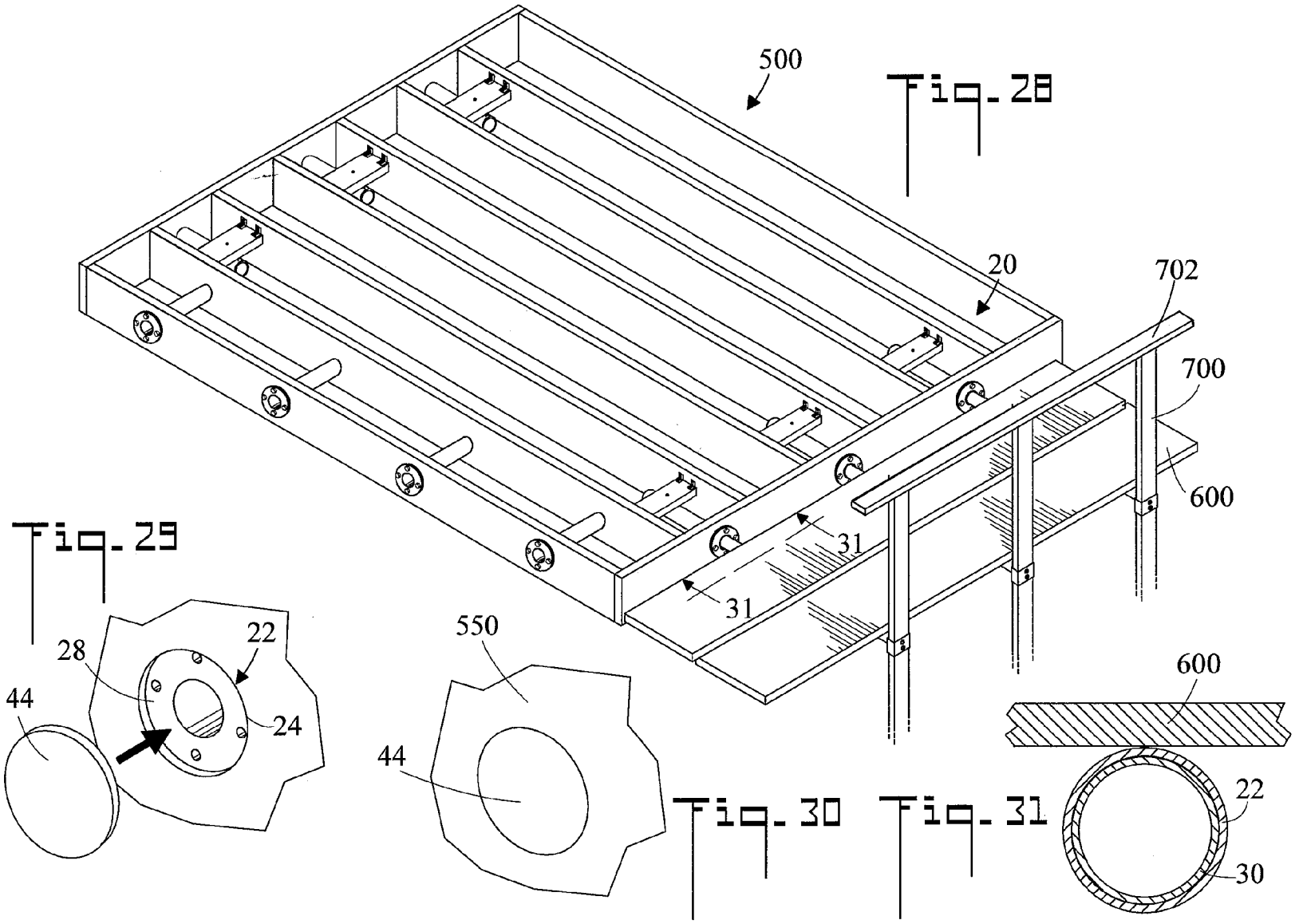
FIG. 28 is a reduced perspective view of a flooring structure with the scaffolding apparatus and the vertical scaffold member.
FIG. 29 is an enlarged fragmented perspective view of a cover being placed over the proximal end of the sleeve.
FIG. 30 is an enlarged fragmented perspective view of the cover covering the proximal end of the sleeve.
FIG. 31 is an enlarged fragmented cross sectional view along the line 31-31 of FIG. 28.

FIG. 27 is a perspective view of another embodiment of platform support arm 30, and FIG. 28 is a reduced perspective view of a flooring structure 500 with the scaffolding apparatus 20 and a vertical scaffold member 700. Platform support arm 30 has a proximal end which includes a collar 42. Collar 42 is shaped and dimensioned to receive vertical scaffold member 700. Vertical scaffold member 700 extends to the ground and serves to stabilize scaffolding apparatus 20 and platform 600, and also accommodates the installation of a safety rail 702. In the shown embodiment collar 42 is rectangular, and is shaped and dimensioned to receive a 2 by 4 board. However, it may be appreciated that collar 42 could have other shapes, such as circular for receiving a metal pipe vertical scaffold member.

FIG. 29 is an enlarged fragmented perspective view of a cover 44 being placed over proximal end 24 sleeve 22, and FIG. 30 is an enlarged fragmented perspective view of cover 44 covering proximal end 24 of sleeve 22. After scaffolding apparatus 20 is used to facilitate initial building construction, platform support arms 30 (refer to FIG. 3) are removed until they are needed for building modifications or maintenance. As such, a cover 44 is provided for both esthetic purposes and to prevent debris, moisture, animals or the like from entering sleeve 22. Cap 44 is designed to match the building facade 550. It may also be appreciated that connector 28 could be countersunk into rim joist 504 for esthetic purposes.

FIG. 31 is an enlarged fragmented cross sectional view along the line 31-31 of FIG. 28. Shown are sleeve 22, platform support arm 30 received by sleeve 22, and platform 600.

Figure 32:
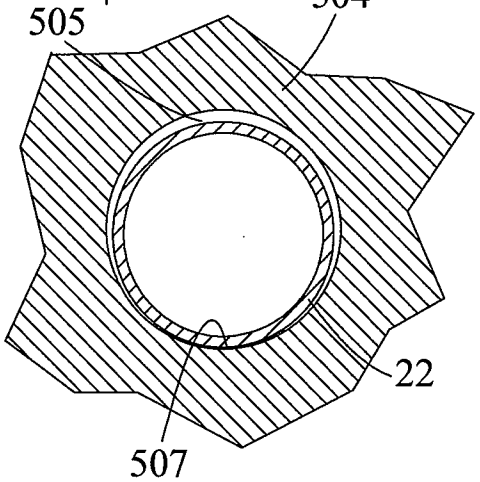
FIG. 32 is an enlarged cross sectional view along the line 32-32 of FIG. 20; and, FIG. 33 is an enlarged fragmented perspective view of another version of FIG. 22.

FIG. 32 is an enlarged cross sectional view along the line 32-32 of FIG. 20 showing sleeve 22 and rim joist 504. Sleeve 22 abuts the bottom 507 of rim joist aperture 505.

Figure 33:
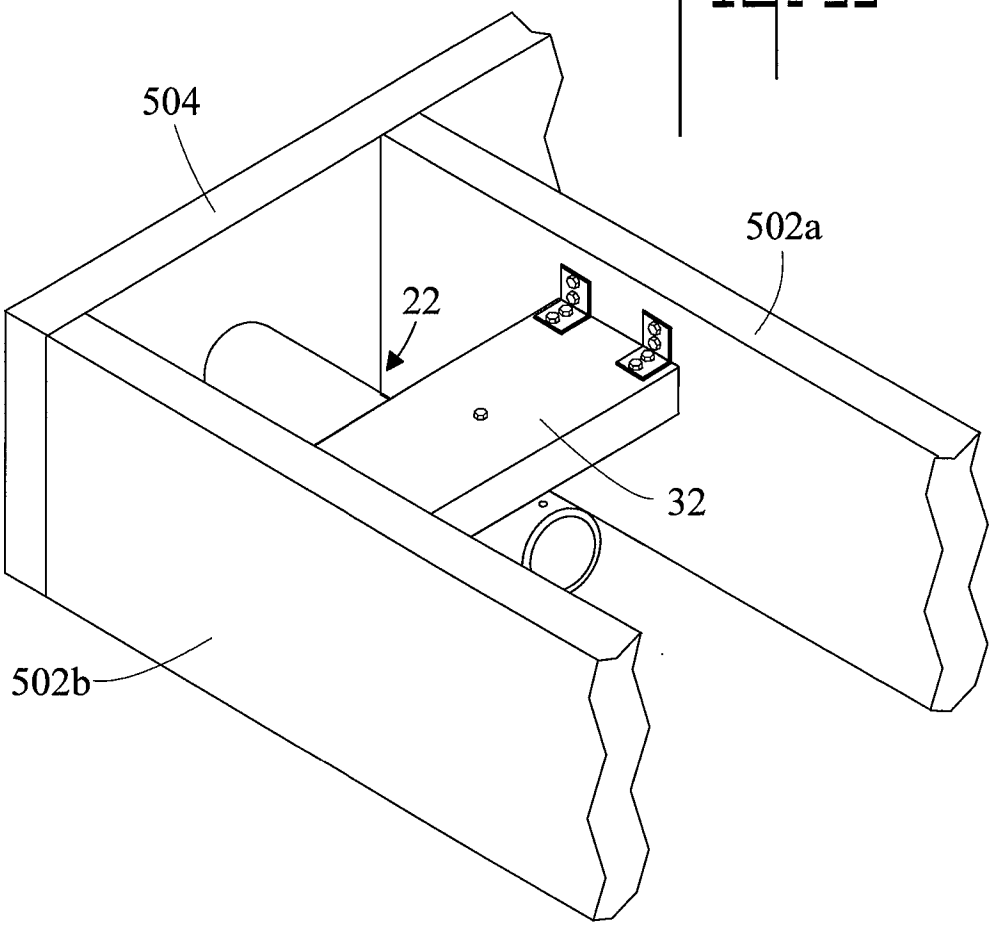

FIG. 33 is an enlarged fragmented perspective view of another version of FIG. 22. This embodiment is the same as the embodiment of FIGS. 21-24 except that in this case one of the two adjacent floor joists (502*b*) also happens to be a rim joist in that it forms an outer perimeter of the flooring structure 500 (also refer to FIG. 1). That is, for the purposes of the scaffolding apparatus 20, joist 502*b* of FIG. 33 can either be referred to as a rim joist 504 (refer to FIGS. 1-3), or as a floor joist 502*b* in FIG. 33. All of the structural features described for FIGS. 21-24 also apply to this version.

It may be appreciated that scaffolding apparatus 20 can be combined with floor joists 502 and rim joists 504 to form a scaffolding system.

In terms of use, a method for erecting scaffolding includes: (refer to FIGS. 1-20, and 24-32)

(a) providing a rim joist 504 which has a rim joist aperture 505;

(b) providing a parallel floor joist 502 which is disposed adjacent to and parallel with the rim joist 504, the floor joist 502 having a floor joist aperture 503;

(c) providing scaffolding apparatus 20, including:

a sleeve 22 which is shaped and dimensioned to be received by the rim joist aperture 505 and by the floor joist aperture 503;

the sleeve 22 having a proximal section 24 which includes a connector 28 for connecting the sleeve 22 to the rim joist 504;

a platform support arm 30 which is shaped and dimensioned to be received by the sleeve 22 and outwardly project therefrom;

(d) passing the sleeve 22 through the rim joist aperture 505 and through the floor joist aperture 503 so that the connector 28 is adjacent to the rim joist 504;

(e) connecting the sleeve 22 to the rim joist 504; and, (f) inserting the platform support arm 30 into the sleeve 22.

The method further including:

in (a), the rim joist aperture 505 having a bottom 507; and, in (e), the sleeve 22 abuts the bottom 507 of the rim joist aperture 505.

The method further including:

in (c), providing a lock for removably connecting the platform support arm 30 to the sleeve 22; and, during (f), using the lock to removably connect the platform support arm 30 to the sleeve 22.

The method further including:

in (c), the lock including;

the platform support arm 30 being a tube having a distal end 31;

the the distal end 31 having two contrapositioned L-shaped slots 38;

the sleeve 22 including a locking rod 36 disposed along a diameter of the sleeve 22; and, the L-shaped slots 38 shaped and dimensioned to twistedly engage the locking rod 36; and, in (f), twisting the platform support arm 30 so that the L-shaped slots 38 engage the locking rod 36.

The method further including:

in (c), the sleeve 22 including a plurality of pairs of spaced apart contrapositioned holes 34 which are shaped and dimensioned to receive the locking rod 36; and, in (e), ensuring that the plurality of pairs of spaced apart contrapositioned holes 34 are oriented along a vertical axis V.

The method further including:

providing a vertical scaffold member 700;

in (c), the platform support arm 30 having a proximal end which includes a collar 42 which is shaped and dimensioned to receive the vertical scaffold member 700; and, after (f), inserting the vertical scaffold member 700 into the collar 42.

In terms of use, another method for erecting scaffolding includes: (refer to FIGS. 1-17, and 21-33)

(a) providing a rim joist 504 which has a rim joist aperture 505;

(b) providing two adjacent floor joists 502*a* and 502*b* which are disposed perpendicular to the rim joist 504;

(c) providing scaffolding apparatus 20, including:

a sleeve 22 which is shaped and dimensioned to be received by the rim joist aperture 505;

the sleeve 22 having a proximal section 24 which includes a connector 28 for connecting the sleeve 22 to the rim joist 504;

a stop 32 which is connectable between the two adjacent floor joists 502*a* and 502*b* so that the stop 32 is disposed above and adjacent to the sleeve 22;

a platform support arm 30 which is shaped and dimensioned to be received by the sleeve 22 and outwardly project therefrom;

(d) passing the sleeve 22 through the rim joist aperture 505 so that the connector 28 is adjacent to the rim joist 504;

(e) connecting the sleeve 22 to the rim joist 504;

(f) connecting the stop 32 to the two adjacent floor joists 502*a* and 502*b* so that the stop 32 is above and adjacent to the sleeve 22; and, (g) inserting the platform support arm 30 into the sleeve 22.

The embodiments of the scaffolding apparatus and method of use described herein are exemplary and numerous modifications, combinations, variations, and rearrangements can be readily envisioned to achieve an equivalent result, all of which are intended to be embraced within the scope of the appended claims. Further, nothing in the above provided discussions of the scaffolding apparatus and method should be construed as limiting the invention to a particular embodiment or combination of embodiments. The scope of the invention is defined by the appended claims.

I claim:

1. A scaffolding apparatus which cooperates with a flooring structure, the flooring structure including (1) a rim joist which has a rim joist aperture, and (2) a plurality of floor joists, the plurality of floor joists including a parallel floor joist which is disposed adjacent to and parallel with the rim joist, the parallel floor joist having a floor joist aperture, the scaffolding apparatus comprising:

a sleeve which is shaped and dimensioned to be received by the rim joist aperture;

said sleeve having a proximal section which includes a connector for connecting said sleeve to the rim joist, said sleeve is positionable so that (1) said sleeve passes through the rim joist aperture and said connector is adjacent to the rim joist, and (2) said sleeve is restrained by at least one of said plurality of floor joists such that said sleeve is prevented from moving upward;

a platform support arm which is shaped and dimensioned to be received by said sleeve and outwardly project therefrom;

said sleeve is shaped and dimensioned to be received by the floor joist aperture; and, said sleeve is positionable so that said sleeve passes through the floor joist aperture.

2. A scaffolding apparatus which cooperates with a flooring structure, the flooring structure including (1) a rim joist which has a rim joist aperture, and (2) a plurality of floor joists, the scaffolding apparatus comprising:

a sleeve which is shaped and dimensioned to be received by the rim joist aperture;

said sleeve having a proximal section which includes a connector for connecting said sleeve to the rim joist, said sleeve is positionable so that (1) said sleeve passes through the rim joist aperture and said connector is adjacent to the rim joist, and (2) said sleeve is restrained by at least one of said plurality of floor joists such that said sleeve is prevented from moving upward;

a platform support arm which is shaped and dimensioned to be received by said sleeve and outwardly project therefrom;

a lock for removably connecting said platform support arm to said sleeve;

said lock including;

said platform support arm being a tube having a distal end;

said distal end having two contrapositioned L-shaped slots;

said sleeve including a locking rod disposed along a diameter of said sleeve; and, said L-shaped slots are shaped and dimensioned to twistedly engage said locking rod.

3. The scaffolding apparatus according to claim 2, further including:

said two L-shaped slots each including a tapered base section.

4. The scaffolding apparatus according to claim 2, further including:

said sleeve including a plurality of pairs of spaced apart contrapositioned holes which are shaped and dimensioned to receive said locking rod.

5. A scaffolding system, comprising:

a flooring structure which includes (1) a rim joist which has a rim joist aperture, and (2) a plurality of floor joists;

a sleeve which is shaped and dimensioned to be received by said rim joist aperture;

said sleeve having a proximal section which includes a connector for connecting said sleeve to said rim joist;

said sleeve is positionable so that (1) said sleeve passes through said rim joist aperture and said connector is adjacent to said rim joist, and (2) said sleeve is restrained by at least one of said plurality of floor joists such that said sleeve is prevented from moving upward;

a platform support arm which is shaped and dimensioned to be received by said sleeve and outwardly project therefrom;

said plurality of floor joists including a parallel floor joist which is disposed adjacent to and parallel with said rim joist, said parallel floor joist having a floor joist aperture;

said sleeve is shaped and dimensioned to be received by said floor joist aperture; and, said sleeve is positionable so that said sleeve passes through said floor joist aperture.

6. A scaffolding system, comprising:

a flooring structure which includes (1) a rim joist which has a rim joist aperture, and (2) a plurality of floor joists;

a sleeve which is shaped and dimensioned to be received by said rim joist aperture;

said sleeve having a proximal section which includes a connector for connecting said sleeve to said rim joist;

said sleeve is positionable so that (1) said sleeve passes through said rim joist aperture and said connector is adjacent to said rim joist, and (2) said sleeve is restrained by at least one of said plurality of floor joists such that said sleeve is prevented from moving upward;

a platform support arm which is shaped and dimensioned to be received by said sleeve and outwardly project therefrom;

a lock for removably connecting said platform support arm to said sleeve;

said lock including;

said platform support arm being a tube having a distal end;

said distal end having two contrapositioned L-shaped slots;

said sleeve including a locking rod disposed along a diameter of said sleeve; and, said L-shaped slots are shaped and dimensioned to twistedly engage said locking rod.

7. The scaffolding system according to claim 6, further including:

said two L-shaped slots each including a tapered base section.

8. The scaffolding system according to claim 6, further including:

said sleeve including a plurality of pairs of spaced apart contrapositioned holes which are shaped and dimensioned to receive said locking rod.

9. A method for erecting scaffolding, comprising:

(a) providing a rim joist which has a rim joist aperture;

(b) providing a parallel floor joist which is disposed adjacent to and parallel with said rim joist, said floor joist having a floor joist aperture;

(c) providing scaffolding apparatus, including:

a sleeve which is shaped and dimensioned to be received by said rim joist aperture and by said floor joist aperture;

said sleeve having a proximal section which includes a connector for connecting said sleeve to said rim joist;

a platform support arm which is shaped and dimensioned to be received by said sleeve and outwardly project therefrom;

(d) passing said sleeve through said rim joist aperture and through said floor joist aperture so that said connector is adjacent to said rim joist;

(e) connecting said sleeve to said rim joist; and, (f) inserting said platform support arm into said sleeve.

10. The method of claim 9, further including:

in (a), said rim joist aperture having a bottom; and, in (d), said sleeve abuts said bottom of said rim joist aperture.

11. The method of claim 9, further including:

in (c), providing a lock for removably connecting said platform support arm to said sleeve; and, during (f), using said lock to removably connect said platform support arm to said sleeve.

12. The method of claim 11, further including:

in (c), said lock including;

said platform support arm being a tube having a distal end;

said said distal end having two contrapositioned L-shaped slots;

said sleeve including a locking rod disposed along a diameter of said sleeve;

said L-shaped slots are shaped and dimensioned to twistedly engage said locking rod; and, in (f), twisting said platform support arm so that said L-shaped slots engage said locking rod.

13. The method of claim 12, further including:

in (c), said sleeve including a plurality of pairs of spaced apart contrapositioned holes which are shaped and dimensioned to receive said locking rod; and, in (e), ensuring that said plurality of pairs of spaced apart contrapositioned holes are oriented along a vertical axis.

14. The method of claim 9, further including:

providing a vertical scaffold member;

in (c), said platform support arm having a proximal end which includes a collar which is shaped and dimensioned to receive said vertical scaffold member; and, after (f), inserting said vertical scaffold member into said collar.

15. A method for erecting scaffolding, comprising:

(a) providing a rim joist which has a rim joist aperture;

(b) providing two adjacent floor joists which are disposed perpendicular to said rim joist;

(c) providing scaffolding apparatus, including:

a sleeve which is shaped and dimensioned to be received by said rim joist aperture;

said sleeve having a proximal section which includes a connector for connecting said sleeve to said rim joist;

a stop which is connectable between said two adjacent floor joists so that said stop is disposed above and adjacent to said sleeve;

a platform support arm which is shaped and dimensioned to be received by said sleeve and outwardly project therefrom;

(d) passing said sleeve through said rim joist aperture so that said connector is adjacent to said rim joist;

(e) connecting said sleeve to said rim joist;

(f) connecting said stop to said two adjacent floor joists so that said stop is above and adjacent to said sleeve;

(g) inserting said platform support arm into said sleeve;

in (c), providing a lock for removably connecting said platform support arm to said sleeve;

during (g), using said lock to removably connect said platform support arm to said sleeve;

in (c), said lock including;

said platform support arm being a hollow tube having a distal end;

said distal end having two contrapositioned L-shaped slots;

said sleeve including a locking rod disposed along a diameter of said sleeve; and, said L-shaped slots are shaped and dimensioned to twistedly engage said locking rod; and, in (g), twisting said platform support arm so that said L-shaped slots engage said locking rod.

16. The method of claim 15, further including:

in (c), said sleeve including a plurality of pairs of spaced apart contrapositioned holes which are shaped and dimensioned to receive said locking rod; and, in (e), ensuring that said plurality of pairs of spaced apart contrapositioned holes are oriented along a vertical axis.

* * * * *